US007209879B2

(12) United States Patent
Eriksson et al.

(10) Patent No.: US 7,209,879 B2
(45) Date of Patent: Apr. 24, 2007

(54) NOISE SUPPRESSION

(75) Inventors: Anders Eriksson, Uppsala (SE); Tönu Trump, Bandhagen (SE)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 908 days.

(21) Appl. No.: 10/105,884

(22) Filed: Mar. 26, 2002

(65) Prior Publication Data

US 2002/0184010 A1 Dec. 5, 2002

(30) Foreign Application Priority Data

Mar. 30, 2001 (SE) ..... 0101157
Jul. 13, 2001 (SE) ..... 0102519

(51) Int. Cl.
*G10L 21/02* (2006.01)

(52) U.S. Cl. ..... 704/226

(58) Field of Classification Search ..... None
See application file for complete search history.

(56) References Cited

U.S. PATENT DOCUMENTS 5,148,488 A * 9/1992 Chen et al. ..... 704/219
5,307,405 A * 4/1994 Sih ..... 379/406.08
5,434,947 A * 7/1995 Gerson et al. ..... 704/219
5,570,453 A * 10/1996 Gerson et al. ..... 704/219
5,706,395 A * 1/1998 Arslan et al. ..... 704/226
5,913,187 A * 6/1999 Mermelstein ..... 704/219
5,966,689 A * 10/1999 McCree ..... 704/226

FOREIGN PATENT DOCUMENTS

EP 1 081 684 A 3/2001
WO WO 9901864 1/1999
WO 01/18960 A1 3/2001
WO WO 0118960 3/2001

OTHER PUBLICATIONS

Chandran, R. et al. "Compressed Domain Noise Reduction and Echo Suppress Network Speech Enhancement" Circuit and Systems, 2000; Proceedings of the Midwest Symposium on Aug. 2000, vol. 1, pp. 10-13, ISBN: 0-7803-6475-9; see "Abstract," "Introduction" and p. 11.

Gustafsson, H. et al. "Special Subtraction Using Correct Convolution and a Spectrum Dependent Exponential Averaging Method," University of Karlskrona Ronneby, Research Report 15/98; ISSN 1103-1581, Aug. 25, 1998, pp. 1-36.

*Technical Specification 3G TS 26.090 V3.1.0,* Dec. 1999, 3rd Generation Partnership Project; Technical Specification Group Services and System Aspects; Mandatory Speech Codec speech processing functions, AMR speech codec; Transcoding functions, pp. 1-62.

*Research Report 15/98*, Department of Signal Processing, University of Karlskrona/Ronneby, Ronneby, Sweden, Aug. 25, 1998, Harald Gustafsson et al., "Spectral Subtraction Using Correct Convolution and a Spectrum Dependent Exponential Averaging Method", pp. 1-36.

*ICSLP'98,* Nov. 30, 1998, XP0021185671, Sydney, Australia, J.M. Huerta et al., "Speech recognition from GSM codec parameters", pp. 1-4.

* cited by examiner

*Primary Examiner*—David D. Knepper
(74) *Attorney, Agent, or Firm*—Nixon & Vanderhye P.C.

(57) ABSTRACT

A network noise suppressor includes a decoder for partially decoding a CELP coded bit-stream. A noise suppressing filter H(z) is determined from the decoded parameters. The filter is used to determine modified LP and gain parameters. Corresponding parameters in the coded bit-stream are overwritten with the modified parameters.

18 Claims, 6 Drawing Sheets

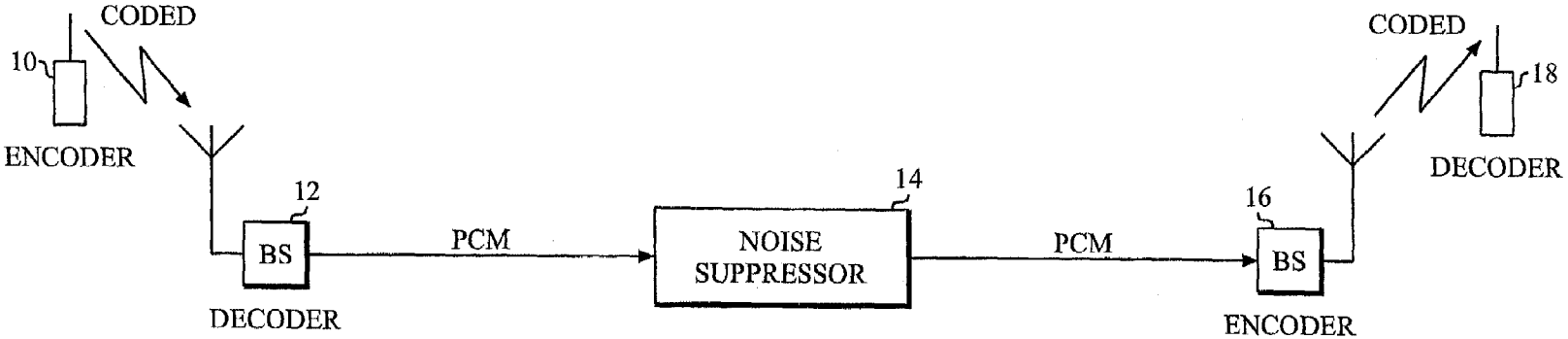
Fig. 1
(CONVENTIONAL)
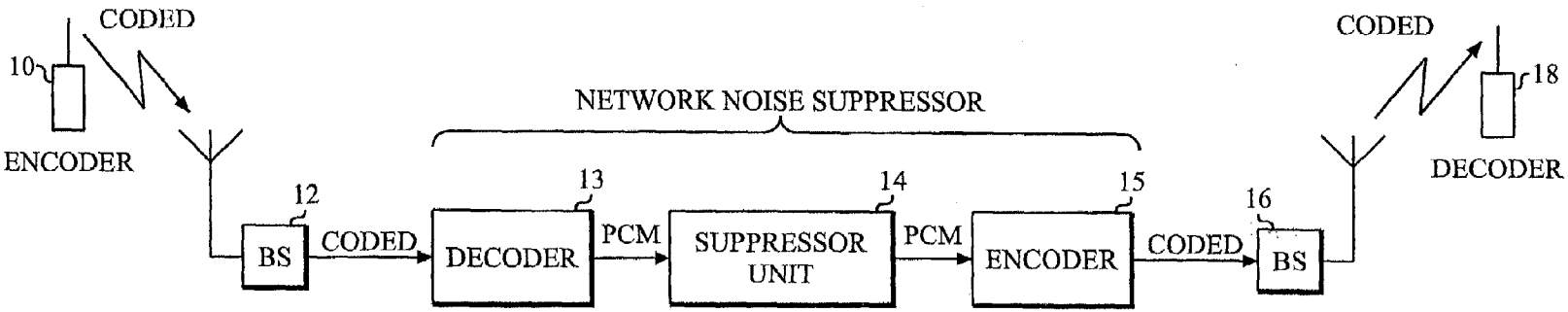
Fig. 2
(CONVENTIONAL)

NOISE SUPPRESSION

TECHNICAL FIELD

The present invention relates to noise suppression in telephony systems, and in particular to network-based noise suppression.

BACKGROUND

Noise suppression is used to suppress any background acoustic sound superimposed on the desired speech signal, while preserving the characteristics tics of the speech. In most applications, the noise suppressor is implemented as a pre-processor to the speech encoder. The noise suppressor may also be implemented as an integral part of the speech encoder.

There also exist implementations of noise suppression algorithms that are installed in the networks. The rationale for using these network-based implementations is that a noise reduction can be achieved also when the terminals do not contain any noise suppression. These algorithms operate on the PCM (Pulse Code Modulated) coded signal and are independent of the bit-rate of the speech-encoding algorithm. However, in a telephony system using low speech coding bit-rate (such as digital cellular systems), network based noise suppression can not be achieved without introducing a tandem encoding of the speech. For most current systems this is not a severe restriction, since the transmission in the core network usually is based on PCM coded speech, which means that the tandem coding already exists. However, for tandem free or transcoder free operation, a decoding and subsequent encoding of the speech has to be performed within the noise-suppressing device itself, thus breaking the otherwise tandem free operation. A drawback of this method is that tandem coding introduces a degradation of the speech, especially for speech encoded at low bit-rates.

SUMMARY

An object of the present invention is a noise reduction in an encoded speech signal formed by LP (Linear Predictive) coding, especially low bit-rate CELP (Code Excited Linear Predictive) encoded speech, without introducing any tandem encoding.

This object is achieved in accordance with the attached claims.

Briefly, the present invention is based on modifying the parameters containing the spectral and gain information in the coded bit-stream while leaving the excitation signals unchanged. This gives noise suppression with improved speech quality for systems with transcoder free operation.

BRIEF DESCRIPTION OF THE DRAWINGS

The invention, together with further objects and advantages thereof, may best be understood by making reference to the following description taken together with the accompanying drawings, in which:

FIG. 1 is a block diagram of a typical conventional communication system including a network noise suppressor;

FIG. 2 is a block diagram of another typical conventional communication system including a network noise suppressor;

DETAILED DESCRIPTION

Figure 3:
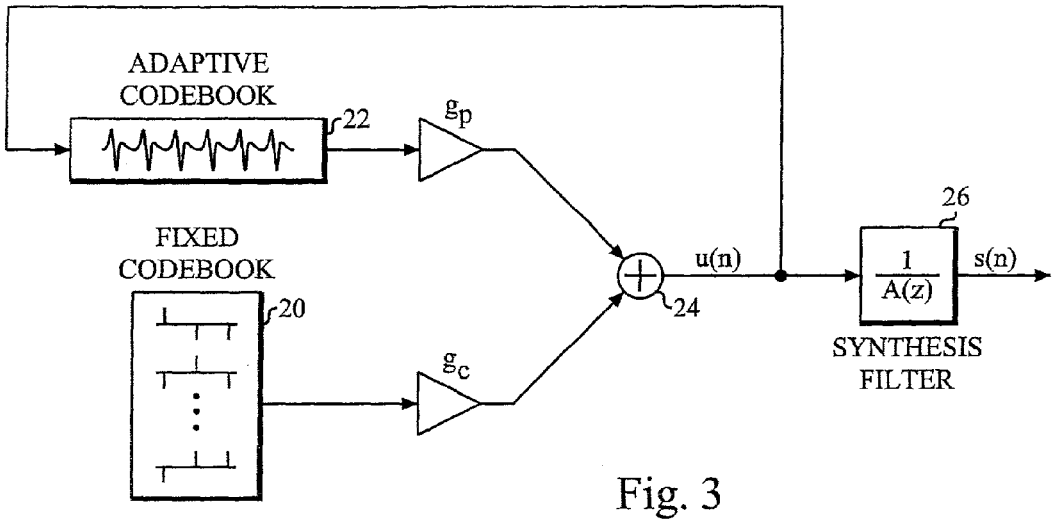
FIG. 3 is a simplified block diagram of the CELP synthesis model.

In the following description elements performing the same or similar functions have been provided with the same reference designations.

FIG. 1 is a block diagram of a typical conventional communication system including a network noise suppressor. A transmitting terminal 10 encodes speech and transmits the coded speech signal to a base station 12, where it is decoded into a PCM signal. The PCM signal is passed through a noise suppressor 14 in the core network, and the modified PCM signal is passed to a second base station 16, in which it is encoded and transmitted to a receiving terminal 18, where it is decoded into a speech signal.

FIG. 2 is a block diagram of another typical conventional communication system including a network noise suppressor. This embodiment differs from the embodiment of FIG. 1 in that the coded speech signal is also used in the core network, thereby increasing the capacity of the network, since the coded signal requires a lower bit-rate than a conventional PCM signal. However, the noise suppression algorithm used performs the suppression on the PCM signal. For this reason the network noise suppressor in addition to the actual noise suppressor unit 14 also includes a decoder 13 for decoding the received coded speech signal into a PCM signal and an encoder 15 for encoding the modified PCM signal. This feature is called tandem encoding. A drawback of tandem encoding is that at low speech coding bit-rates the encoding-decoding-encoding process leads to a degradation in speech quality. The reason for this is that the decoded signal, on which the noise suppression algorithm is applied, may not accurately represent the original speech signal due to the low coding bit-rate. A second encoding of this signal (after noise suppression) may therefore lead to poor representation of the original speech signal.

The present invention solves this problem by avoiding the second encoding step of the conventional systems. Instead of modifying the samples of a decoded PCM signal, the present invention performs noise suppression directly in the speech coded bit-stream by modifying certain speech parameters, as will be described in more detail below.

The present invention will now be explained with reference to CELP coding. However, it is to be understood that the same principles may be used for any type of linear predictive coding FIG. 3 is a simplified block diagram of the CELP synthesis model. Vectors from a fixed codebook 20 and an adaptive codebook 22 are amplified by gains $g_c$ and $g_p$, respectively, and added in an adder 24 to form an excitation signal u(n). This signal is forwarded to an LP synthesis filter 26 described by a filter 1/A(z), which produces a speech signal s(n). This can be described by the equation $$s(n) = \frac{1}{A(z)}u(n)$$

The parameters of the filter A(z) and the parameters defining excitation signal u(n) are derived from the bit-stream produced by the speech encoder.

A noise suppression algorithm can be described as a linear filter operating on the speech signal produced by the speech decoder, i.e.

$$y(n)=H(z)s(n)$$

where the (time-varying) filter H(z) is designed so as to suppress the noise while retaining the basic characteristics of the speech, see e.g. WO 01/18960 A1 for more details on the derivation of the filter H(z).

Now, applying the knowledge of how the speech decoder produces the decoded speech, a noise-suppressed signal can be achieved at the output of the speech decoder as $$y(n) = H(z)s(n) = \frac{H(z)}{A(z)}u(n)$$

The basic idea of the invention is to approximate the filter H(z)/A(z) with an AR (Auto Regressive) filter $\tilde{A}(z)$ of the same order as A(z) and a gain factor α. Thus, the noise-suppressed signal at the output of the speech decoder can be approximated as $$y(n) = H(z)s(n) = \frac{H(z)}{A(z)}u(n) \approx \frac{1}{\tilde{A}(z)}\alpha u(n)$$

Hence, by replacing the parameters in the coded bit-stream describing the filter A(z) and the gain of the excitation signal with new parameters describing $\tilde{A}(z)$ and a gain reduced by α, the noise suppression can be performed without introducing any complete decoding and subsequent coding of the speech.

Figure 4:
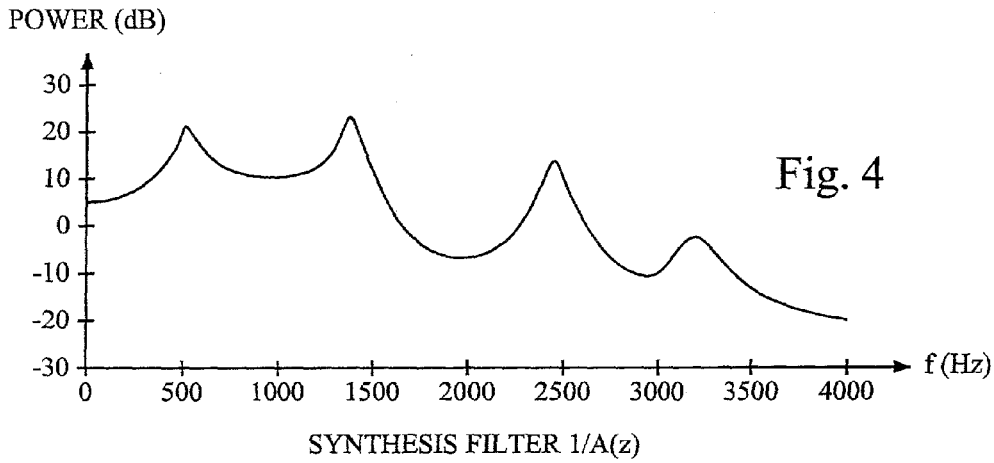
FIG. 4 is a diagram illustrating the power transfer function of an LP synthesis filter.

FIG. 4 is a diagram illustrating the power transfer function of an LP synthesis filter. It is characterized by peaks at certain frequencies interconnected by valleys.

Figure 5:
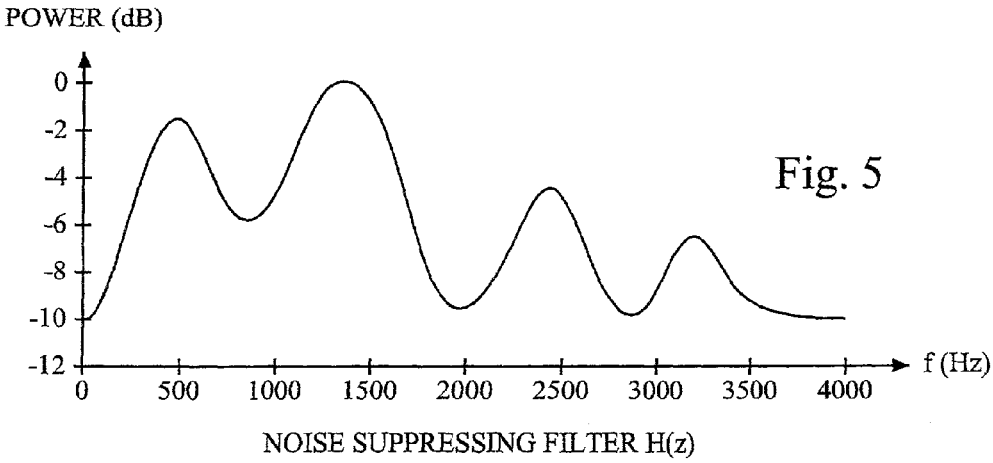
FIG. 5 is a diagram illustrating the power transfer function of a noise-suppressing filter.
Figure 6:
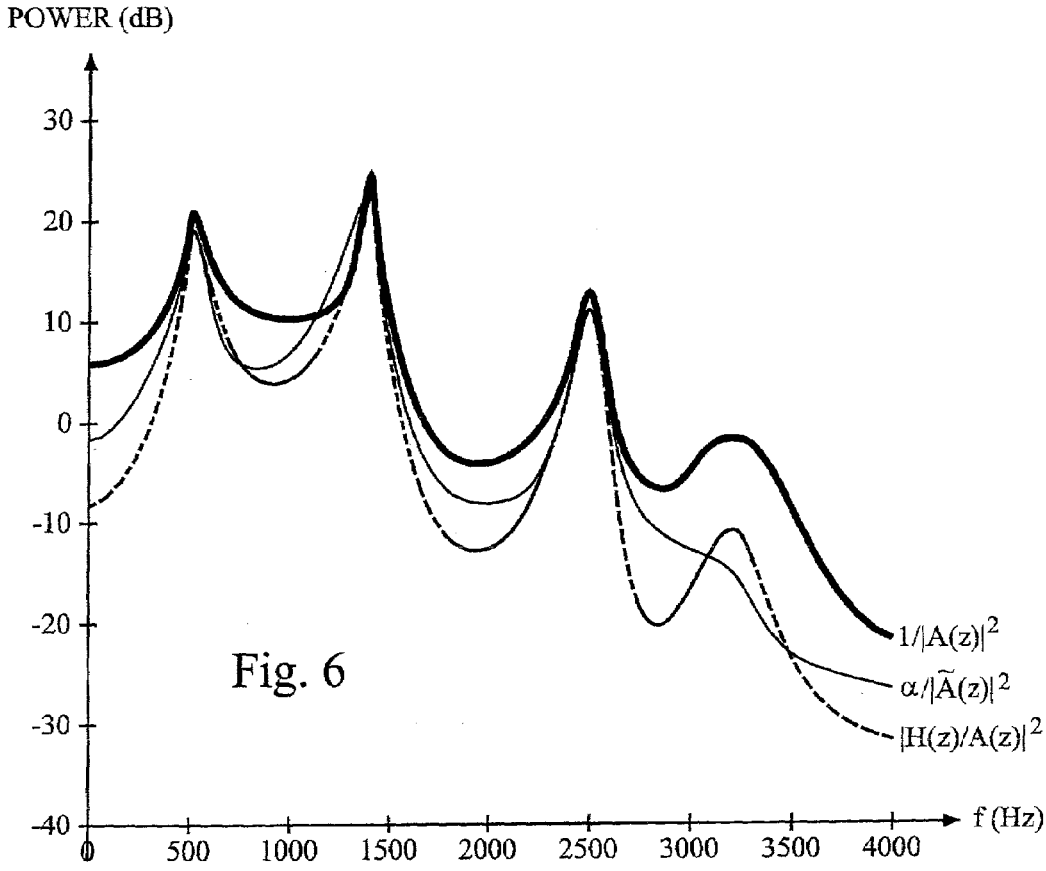
FIG. 6 is a diagram comparing the power transfer function of the original synthesis filter to the true and approximate noise suppressed filters.

FIG. 5 is a diagram illustrating the power transfer function of a noise-suppressing filter. It is noted that it has peaks at approximately the same frequencies as the spectrum in FIG. 4. The effect of applying this filter to the spectrum in FIG. 4 is to sharpen the peaks and to lower the valleys, as illustrated by FIG. 6, which is a diagram comparing the power transfer function of the original synthesis filter to the true and approximate noise suppressed filters.

Figure 7:
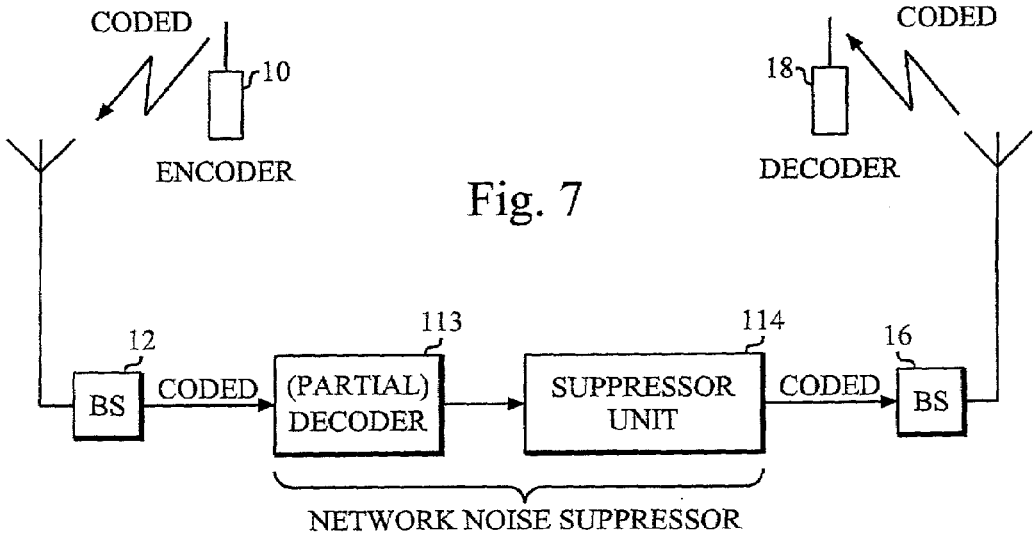
FIG. 7 is a block diagram of a communication system including a network noise suppressor in accordance with the present invention.

FIG. 7 is a block diagram of a communication system including a network noise suppressor in accordance with the present invention. As can be seen from FIG. 7, the encoder between noise suppressor unit 114 and base station 16 has been eliminated. According to the invention, noise suppression is performed directly on the parameters of the coded bit-stream, which makes the encoder unnecessary. Furthermore, decoder 113 may perform either a complete or a partial decoding, depending on the algorithm used, as will be described in further detail below. In both cases the decoding is only used to determine the necessary modification of parameters in the coded bit-stream.

Figure 8:
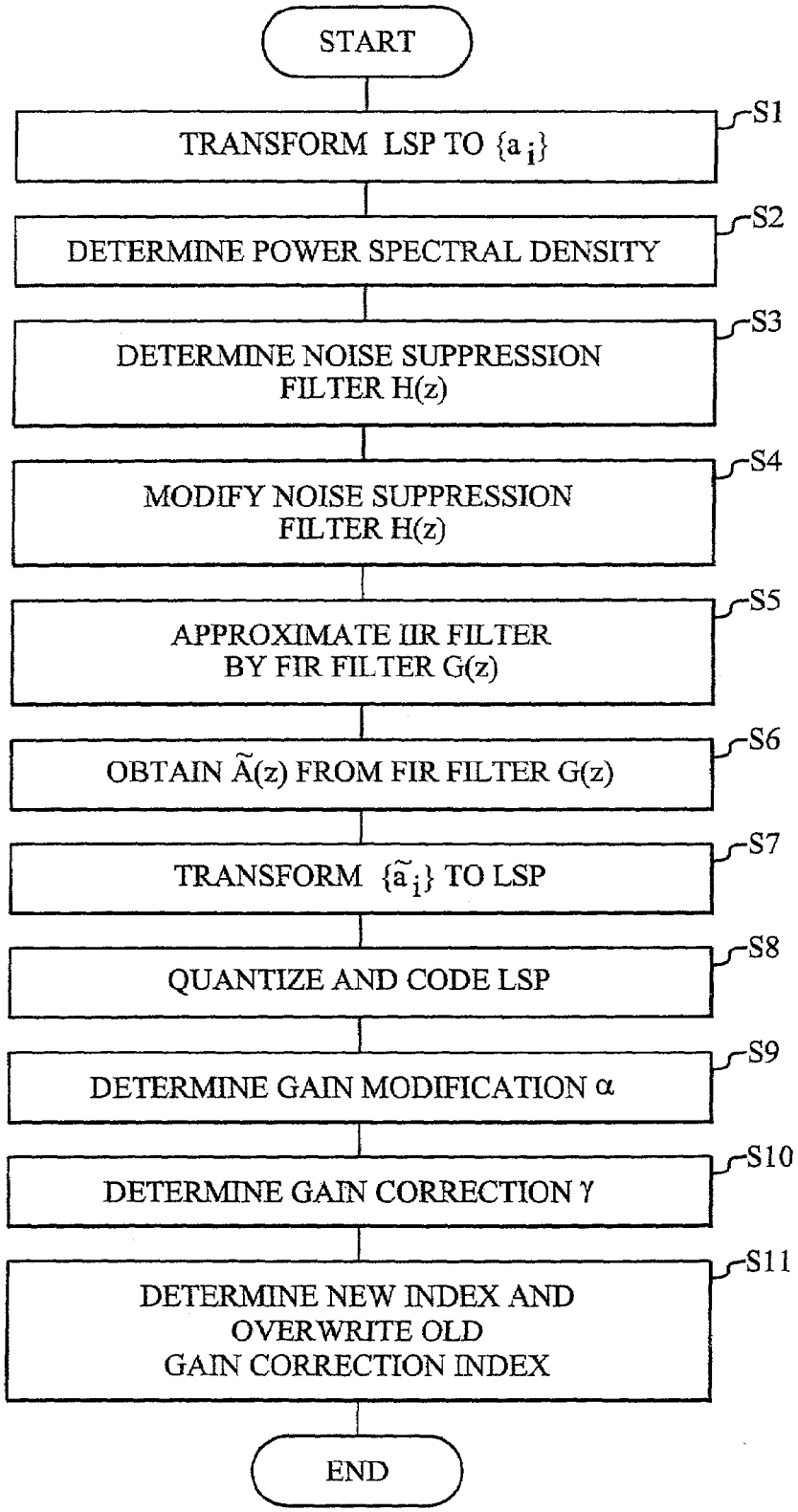
FIG. 8 is a flow chart illustrating an exemplary embodiment of a noise suppression method in accordance with the present invention.

As an example of how the modification of the bit stream is performed, the application of the present invention to the 12.2 kbit/s mode of the Adaptive Multi-Rate (AMR) speech encoder for the GSM and UMTS systems will now be described with reference to FIG. 8. However, the present invention is not limited to this speech codec, but can easily be extended to any speech codec for which a parametric spectrum and a coded innovation sequence are part of the coded parameters. As seen from FIG. 3, the parameters to be modified in order to achieve the noise reduction are the parameters describing the LP synthesis filter A(z) and the gain of the fixed codebook $g_c$. The codewords representing the fixed and adaptive codebook vectors do not have to be altered and neither does the adaptive codebook gain $g_p$ (in this mode). The procedure can be summarized by the following steps, which are illustrated in FIG. 8.

S1. The first step is to transform the quantized LSP (Line Spectral Pair) representing filter A(z) to the corresponding filter coefficients $\{a_i\}$, as described in the example of an AMR codec in section 5.2.4 of 3G TS 26.090 v3.1.0. 3GPP, France. 1999:

Once the LSPs are quantified and interpolated, they are converted back to the LP coefficient domain $\{a_k\}$. The conversion to the LP domain is done as follows. The coefficients of $F_1$ (z) or $F_2$ (z) are found by expanding equations (14) and (15) knowing the quantified and interpolated LSPs $q_i$, i=1, . . . , 10. The following recursive relation is used to compute $f_1(i)$:

for i=1 to 5

$$f_1(i)=-2q_{2i-1}f_1(i-1)+2f_1(i-2)$$

for j=i−1 down to 1

$$f_1(j)=f_1(j)-2q_{2i-1}f_1(j-1)+f_1(j-2)$$

end end with initial values $f_1(0)=1$ and $f_1(-1)=0$. The coefficients $f_2$ (i) are computed similarly by replacing $q_{2i-1}$ by $q_{2i}$.

Once the coefficients $f_1(i)$ and $f_2(i)$ are found, $F_1(z)$ and $F_2(z)$ are multiplied by $1+z^{-1}$ and $1-z^{-1}$, respectively, to obtain $F_1'(z)$ and $F_2'(z)$; that is:

$$f_1'(i)=f_1(i)+f_1(i-1),\ i=1, \ldots, 5$$

$$f_2'(i)=f_2,(i)-f_2(i-1),\ i=1, \ldots, 5$$

Finally the LP coefficients are found by:

$$a_i = \begin{cases} 0.5f_1'(i) + 0.5f_2'(i), & i = 1, \ldots, 5 \\ 0.5f_1'(11-i) - 0.5f_2'(11-i), & i = 6, \ldots, 10. \end{cases}$$

This is directly derived from the relation $A(z)=(F_1'(z)+F_2'(z))/2$, and considering the fact that $f_1'(z)$ and $F_2'(z)$ are symmetric and anti-symmetric polynomials, respectively.

S2. In order to determine the noise suppressing filter H(z) a measure of the power spectral density $\hat{\Phi}_x(k)$ of the coded speech signal is required. Using the determined filter coefficients $\{a_i\}$ this can be found as $$\hat{\Phi}_x(k) = \frac{\sigma^2}{\left|1 + \sum_{m=1}^{M} a_m e^{-j2\pi m\frac{k}{K}}\right|^2}$$

where $\sigma^2$ is obtained from the fixed codebook gain $g_c$ and adaptive codebook gain $g_p$ in accordance with $$\sigma^2 = g_c^2 + g_p^2$$

Another possibility is to completely decode the speech signal and to use the fast Fourier transform to obtain $\hat{\Phi}_x(k)$.

S3. Determine the noise suppressing filter H(z) as $$H(k) = \left(1 - \delta\left(\frac{\hat{\Phi}_v(k)}{\hat{\Phi}_x(k)}\right)^{\lambda}\right)^{\beta}$$

where $\hat{\Phi}_v(k)$ is the saved power spectral density from an earlier "pure noise" frame and $\beta, \delta, \lambda$ are constants.

Figure 9:
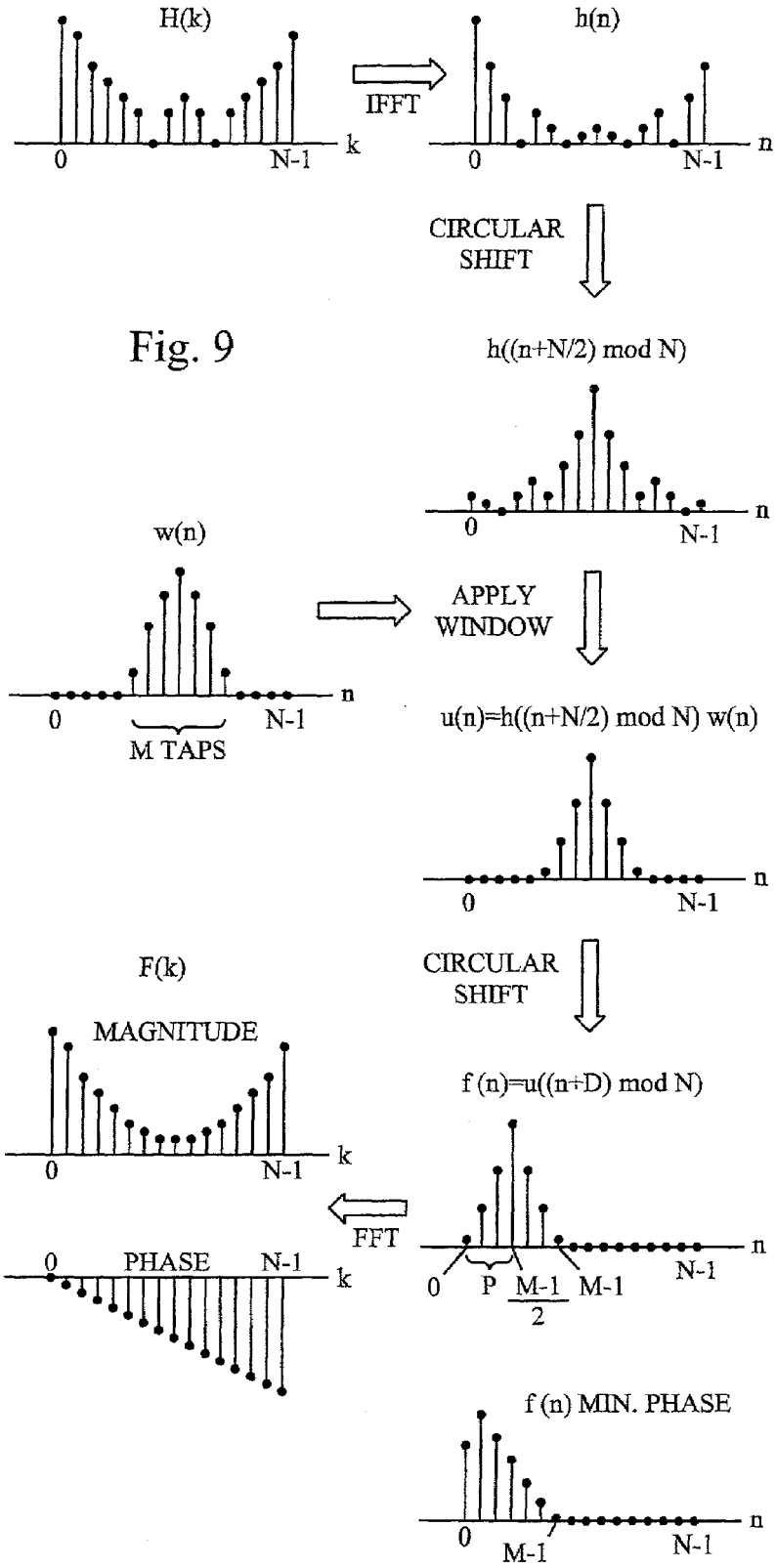
FIG. 9 is a series of diagrams illustrating the modification of the noise suppressing filter.

Modify the filter defined by H(k) as described in WO 01/18960. This gives the desired H(z). The reason for the modification is that noise suppressing filters designed in the frequency domain are real-valued, which leads to a time domain representation in which the peak of the filter is split between the beginning and end of the filter (this is equivalent to a filter that is symmetric around lag 0, i.e. a non-causal filter). This makes the filter unsuitable for circular block convolution, since such a filter will generate temporal aliasing. The performed modification is outlined in FIG. 9. It essentially involves transforming H(k) to the time domain, circularly shifting he transformed filter to make it causal and linear phase, applying a window (to avoid time domain aliasing) to the shifted filter to extract the most significant taps, circularly shifting the windowed filter to remove the initial delay, and (optionally) transforming the linear phase filter to a minimum phase filter. An alternative modification method is described in H. Gustafsson et al., "Spectral subtraction using correct convolution and a spectrum dependent exponential averaging method". Research Report 15/98. Department of Signal Processing. University of Karlskrona/Ronneby, Sweden, 1998.

S5. Approximate the IIR (Infinite Impulse Response) filter defined as H(z)/A(z) by a FIR (Finite Impulse Response) filter G(z) of length L. The coefficients of G(z) may be found as the first L coefficients of the impulse response g(k) of H(z)/A(z) or by performing the polynomial division H(z)/A(z) and identifying the coefficients for the $z^{-1} \ldots z^{-L}$ terms.

S6. Obtain $\tilde{A}(z)$ from the auto correlation function $$r(k) = \sum_{l=0}^{L} g(l)g(l-k)$$

of G(z) using the Levinson-Durbin algorithm, using for example the approach described in section 5.2.2 of 3G TS 26.090 v3.1.0. 3GPP. France. 1999:

The modified auto-correlations $r^1_{ac}(0)=1.0001\ r_{ac}(0)r^1_{ac}(k)=r_{ac}w_{lag}(k)$, k=1, κ 10, are used to obtain the direct form LP filter coefficients $a_k$, k=1, . . . , 10, by solving the set of equations.

$$\sum_{k=1}^{10} a_k r'_{ac}(|i-k|) = -r'_{ac}(i), \quad i = 1, \ldots, 10.$$

The set of equations is solved using the Levinson-Durbin algorithm. This algorithm uses the following recursion:

$$E_{LD}(0) = r_{ac}'(0)$$

for i=1 to 10 do $a_0^{(i-1)}=1$ $$k_i = -\left[\sum_{j=0}^{i-1} a_j^{(i-1)} r'_{ac}(i-j)\right] \Big/ E_{LD}(i-1)$$

$a_i^{(i)}=k_i$ for j=1 to i−1 do $$a_j^{(i)} = a_j^{(i-1)} + k_i a_{i-j}^{(i-1)}$$

end $$E_{LD}(i) = (1-k_i^2)E_{LD}(i-1)$$

end

The final solution is even as $a_j=a_j^{(10)}$ j=1, . . . ,10.

The LP filter coefficients are converted to the line spectral pair (LSP) representation for guantization and interpolation purposes. The conversions to the LSP domain and back to the LP filter coefficient domain are described in the next clause.

S7. Transform the coefficients $\{\tilde{a}_i\}$ that define $\tilde{A}(z)$ into modified LSP parameters as described in for example in section 5.2.3 of 3G TS 26.090 v3.1.0. 3GPP, France. 1999:

The LP filter coefficients a,k=1, . . . ,10, are converted to the line speciral pair (LSP) representation for guantization and interpolation purposes. For a 10th order LP filter, the LSPs are defined as the roots of the sum and difference polynomials:

$$F_1'(z) = A(z) + z^{-11}A(z^{-1})$$

and $$F_2'(z) = A(z) - z^{-11}A(z^{-1}),$$

respectively The polynomial $F_1'(z)$ and $F_2'(z)$ are symmetric and anti-symmetric, respectively. It can be prove that all roots of these polynomials are on the unit circle and they alternate each other. $F_1'(z)$ has a root z=−1 (ω=π) and $F_2'(z)$ has a root z=1 (ω=0). To eliminate these two roots, we define the new polynomials:

$$F_1(z) = F_1'(z)/(1+z^{-1})$$

and $$F_2(z) = F_2'(z)/(1-z^{-1})$$

Each polynomial has 5 conjugate roots on the unit circle $e^{\pm j\omega_i}$), therefore, the polynomials can be written as $$F_1(z) = \prod_{i=1.3K,9} (1 - 2q_i z^{-1} + z^{-2}) \text{ and}$$

$$F_2(z) = \prod_{i=2.4K,10} (1 - 2q_i z^{-1} + z^{-2}),$$

where $q_i = \cos(\omega_i)$ with $\omega_i$ being the line spectral frequencies (LSF) and they satisfy the ordering property $0<\omega_1<\omega_2< \ldots <\omega_{10}\pi$. We refer to $q_i$ as the LSPs in the cosine domain.

Since both polynomials $F_1(z)$ and $F_2(z)$ are symmetric only the first 5 coefficients of each polynomial need to be computed. The coefficients of these polynomials are found by the recursive relations (for i=0 to 4):

$$f_1(i+1)=a_{i+1}+a_{m-i}-f_1(i)$$

$$f_2(i+1)=a_{i+1}-a_{m-i}+f_2(i)$$

where m=10 is the predictor order.

The LSPs are found by evaluating the polynomials $F_1(z)$ and $F_2(z)$ at 60 points equally spaced between 0 and and checking for sign changes. A sign change signifies the existence of a root and the sign change interval is then divided 4 times to better track the root. The Chebyshev polynomials are used to evaluate $F_1(z)$ and $F_2(z)$. In this method the roots are found directly in the cosine domain $\{q_i\}$. The polynomials $F_1(z)$ or $F_2(z)$ evaluated at $z=e^{j\omega}$ can be written as:

$$F(\omega)=2e^{-j5\omega}C(x),$$

with:

$$C(x)=T_5(x)+f(1)T_4(x)+f(2)T_3(x)+f(3)T_2(x)+f(4)T_1(x)+f(5)/2,$$

where $T_m(x)=\cos(m^{\omega})$ is the mth order Chebyshev polynomial, and f(i), i=1, . . . ,5 are the coefficients of either $F_1(z)$ or $F_2(z)$, computed using the equations in (16). The polynomial C(x) is evaluated at a certain value of $x=\cos(\omega)$ using the recursive relation:

for k=4 down to 1

$$\lambda_k=2x\lambda_{k+1}-\lambda_{k+2}+f(5-k)$$

end $$C(x)=x\lambda_1-\lambda_2+f(5)/2,$$

with initial values $\lambda_5=1$ and $\lambda_6=0$.

S8. Quantize and code modified LSP parameters as described for example in 3G TS 26.090 v3.1.0, 3GPP, France, 1999, section 5.2.5 and replace the AR parameter code in the bit-stream. Example LSP guantization for a 12.2 bits/sec mode may be determined as follows:

The two sets of LP filter coefficients per frame are quantified using the LSP representation in the frequency domain; that is:

$$f_i = \frac{f_5}{2\pi}\arccos(q_i), \quad i = 1, \ldots, 10,$$

where $f_i$ are the line spectral frequencies (LSF) in Hz [0,4000] and $f_5$=8000 is the sampling frequency. The LSF vector is given by $f^t=[f_1 f_2 \ldots f_{10}]$, with f denoting transpose.

A 1st order MA prediction is applied, and the two residual LSF vectors are jointly quantified using split matrix guantization (SMQ). The prediction and quantization are performed as follows. Let $z^{(1)}(n)$ and $z^{(2)}(n)$ denote the mean-removed LSF vectors as frame n. The prediction residual vectors $r^{(1)}(n))$ and $r^{(2)}(n)$ are given by:

$$r^{(1)}(n)=z^{(1)}(n)-p(n), \text{ and}$$

$$r^{(2)}(n)=z^{(2)}(n)-p(n)$$

where p(n) is the predicted LSF vector at frame n. First order moving-average (MA) prediction is used where:

$$p(n)=0.65\hat{r}^{(2)}(n-1),$$

where $\hat{r}^{(2)}(n-1)$ is the quantified second residual vector at the past frame.

The two LSF residual vectors $r^{(1)}$ and $r^{(2)}$ are jointly quantified using split matrix quantization (SMQ). The matrix $(r^{(1)}\ r^{(2)})$ is split into 5 submatrices of dimension 2×2 (two elements from each vector). For example, the first submatrix consists of the elements $r_1^{(1)}$, $r_2^{(1)}$, $r_1^{(2)}$, and $r_2^{(2)}$. The 5 submatrices are quantified with 7, 8, 8+1, 8, and 6 bits, respectively. The third submatrix uses a 256-entry signed codebook (8-bit index plus 1-bit sign).

A weighted LSP distortion measure is used in the quantization process. In general, for an input LSP vector f and a quantified vector at index k, $\hat{f}^k$, the quantization is performed by finding the index k which minimizes:

$$E_{LSP} = \sum_{i=1}^{10} \left[ f_i w_i - \hat{f}_i^k w_i \right]^2.$$

The weighting factors $w_i$,i=1, . . . ,10, are given by $$w_i = 3.347 - \frac{1.547}{450} d_i \quad \text{for } d_i < 450,$$

$$= 1.8 - \frac{0.8}{1050}(d_i - 450) \quad \text{otherwise,}$$

where $d_i=f_{i+1}-f_{i-1}$ with $f_0=0$ and $f_{11}=4000$. Here, two sets of weighting coefficients are computed for the two LSF vectors. In the quantification of each submatrix, two weighing coefficients from each set are used with their corresponding LSFs.

S9. The fixed codebook gain modification α is defined by square root of the prediction error power, which is calculated in the same way as $E_{LD}$ as already described above in section 5.2.2 of 3G TS 26.090 v3.1.0. 3GPP, France, 1999.

S10. For the gain of the excitation signal the procedure in section 6.1 of in 3G TS 26.090 v3.1.0, 3GPP, France, 1999 is used. The fixed codebook gain is given by $$\hat{g}_c=\gamma(n)g'_c$$

where the factor γ(n) is the gain correction factor transmitted by the encoder. The factor $\hat{g}'_c$ is given by $$g'_c=10^{0.05(\hat{E}(n)+\overline{EE}-E_1)}$$

where $\bar{E}$ is a constant energy, $E_l$ is the energy of the codeword, and $$\tilde{E}(n) = \sum_{i=1}^{4} b_i \hat{R}(n-i)$$

where $\hat{R}(n)$ are past gain correction factors in a scaled logarithmic domain.

The noise suppression algorithm modifies the gain by the factor $\alpha$. Thus, the gain in the decoder should equal $\alpha$ times the gain in the encoder, i.e.

$$\hat{g}_c^{dec} = \alpha \hat{g}_c^{enc}$$

Using the expressions above it is found that $$\gamma^{new}(n) 10^{0.05(\tilde{E}^{dec}(n)+\bar{E}-E_l)} = \alpha\gamma(n) 10^{0.05(\tilde{E}^{enc}(n)+\bar{E}-E_l)}$$

Hence, the transmitted gain correction factor should be replaced by $$\gamma^{new}(n) = \alpha\gamma(n) 10^{0.05(\tilde{E}^{enc}(n)-\tilde{E}^{dec}(n))}$$

where $\tilde{E}^{enc}(n)$ and $\tilde{E}^{dec}(n)$ are the predicted energies based on the gain factors transmitted by the encoder and the gain factors modified by the noise suppression algorithm.

S11. Find the index of the codeword closest to $\gamma^{new}(n)$ and overwrite the original fixed codebook gain correction index in the coded bit-stream.

In the described example the fixed and adaptive codebook gains are coded independently. In some coding modes with lower bit-rate they are vector quantized. In such a case the adaptive codebook gain will also be modified by the noise suppression. However, the excitation vectors are still unchanged.

Figure 10:
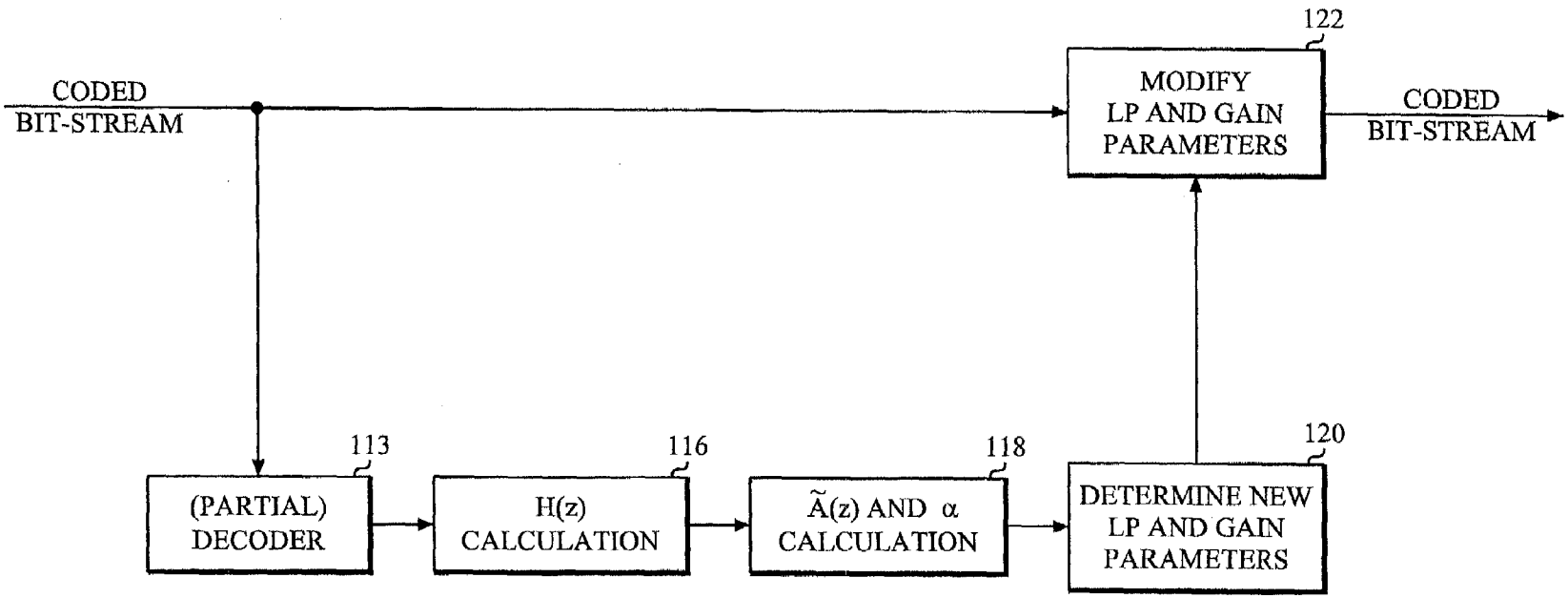
FIG. 10 is a block diagram of an exemplary embodiment of a network noise suppressor in accordance with the present invention.

FIG. 10 is a block diagram of an exemplary embodiment of a network noise suppressor in accordance with the present invention. The received coded bit-stream is (partially) decoded in block 113. Block 116 determines the noise suppressing filter H(z) from the decoded parameters. Block 118 calculates $\tilde{A}(z)$ and $\alpha$. Block 120 determines the new linear predictive and gain parameters. Block 122 modifies the corresponding parameters in the coded bit stream. Typically the functions performed in the network noise suppressor are realized by one or several micro processors or micro/signal processor combinations. However, the same functions may also be realized by application specific integrated circuits (ASIC).

It will be understood by those skilled in the art that various modifications and changes may be made to the present invention without departure from the scope thereof, which is defined by the appended claims.

REFERENCES

[1] WO 01/18960 A1

[2] "AMR speech codec; Transcoding functions", 3G TS 26.090 v3.1.0, 3GPP, France, 1999.

[3] H. Gustafsson et al., "Spectral subtraction using correct convolution and a spectrum dependent exponential averaging method", Research Report 15/98, Department of Signal Processing, University of Karlskrona/Ronneby, Sweden, 1998

The invention claimed is:

1. A noise suppression method, comprising:

representing a noisy signal as an encoded bit stream using a linear predictive filter;

determining a noise suppressing filter from said encoded bit stream;

determining a modified linear predictive filter approximately representing the cascade of said linear predictive filter and said noise suppressing filter; and replacing predetermined coding parameters of the encoded bit stream representing said linear predictive filter with corresponding coding parameters representing said modified linear predictive filter in the encoded bit stream to generate a modified encoded bit stream.

2. The method of claim 1, further comprising:

replacing at least one codebook gain.

3. The method of claim 2, further comprising:

replacing the fixed codebook gain.

4. The method of claim 1, further comprising:

replacing line spectral pair parameters and a codebook gain correction factor.

5. The method of claim 1, wherein some of the predetermined coding parameters are kept unchanged.

6. The method of claim 5, wherein codebook vectors are kept unchanged.

7. A noise suppression system comprising:

means for representing a noisy signal as an encoded bit stream using a linear predictive filter;

means for determining a noise suppressing filter from said encoded bit stream;

means for determining a modified linear predictive filter approximately representing the cascade of said linear predictive filter and said noise suppressing filter; and means for replacing predetermined coding parameters of the encoded bit stream representing said linear predictive filter with corresponding coding parameters representing said modified linear predictive filter in the encoded bit stream to generate a modified encoded bit stream.

8. The system of claim 7, further comprising:

means for modifying at least one codebook gain.

9. The system of claim 8, further comprising:

means for modifying the fixed codebook gain.

10. The system of claim 7, further comprising:

means for modifying line spectral pair parameters and a codebook gain correction factor.

11. A network noise suppressor, comprising:

means for receiving an encoded bit stream representing a noisy signal, said bit encoded stream being formed using a linear predictive filter;

means for determining a noise suppressing filter from said encoded bit stream;

means for determining a modified linear predictive filter approximately representing the cascade of said linear predictive filter and said noise suppressing filter; and means for replacing predetermined coding parameters of the encoded bit stream representing said linear predictive filter with corresponding coding parameters representing said modified linear predictive filter in the encoded bit stream to generate a modified encoded bit stream.

12. The suppressor of claim 11, further comprising:

means for modifying at least one codebook gain.

13. The suppressor of claim 12, further comprising:

means for modifying the fixed codebook gain.

14. The suppressor of claim 11, further comprising:

means for modifying line spectral pair parameters and a fixed codebook gain correction factor.

15. A network noise suppressor, comprising electronic circuitry programmed or configured to perform the following:

receive an encoded bit stream representing a noisy signal, said bit stream being formed using a linear predictive filter;

determine a noise suppressing filter from said encoded bit stream;

determine a modified linear predictive filter approximately representing the cascade of said linear predictive filter and said noise suppressing filter; and replace predetermined coding parameters of the encoded bit stream representing said linear predictive filter with corresponding coding parameters representing said modified linear predictive filter directly in the encoded bit stream to generate a modified encoded bit stream.

16. The suppressor of claim 15, wherein the electronic circuitry is programmed or configured to modify at least one codebook gain.

17. The suppressor of claim 16, wherein the electronic circuitry is programmed or configured to modify line spectral pair parameters and a fixed codebook gain correction factor.

18. The suppressor is claim 15, wherein the electronic circuitry includes one or more microprocessors, one or more signal processors, one or more application specific integrated circuits (ASICs), or a combination thereof.

* * * * *

UNITED STATES PATENT AND TRADEMARK OFFICE

CERTIFICATE OF CORRECTION

PATENT NO. : 7,209,879 B2
APPLICATION NO. : 10/105884
DATED : April 24, 2007
INVENTOR(S) : Eriksson et al.

It is certified that error appears in the above-identified patent and that said Letters Patent is hereby corrected as shown below:

In Column 4, Line 26, delete "v3.1.0." and insert -- v3.1.0, --, therefor.

In Column 4, Line 47, delete "F,(z)" and insert -- $F_2(z)$ --, therefor.

In Column 4, Line 51, "$f_2'(i)=f_2,(i)$" and insert -- $f_2'(i)=f_2(i)$ --, therefor.

In Column 4, Line 62, delete "$f_1'(z)$" and insert -- $F_1'(z)$ --, therefor.

In Column 5, Lines 3-7, delete "
$$\hat{\Phi}_x(k) = \frac{\sigma^2}{\left|1 + \sum_{m=1}^{M} a_m e^{-jpm\frac{k}{K}}\right|^2}$$
" and insert --
$$\hat{\Phi}_x(k) = \frac{\sigma^2}{\left|1 + \sum_{m=1}^{M} a_m e^{-j2\pi m\frac{k}{K}}\right|^2}$$
--, therefor.

In Column 5, Line 63, delete "v3.1.0. 3GPP. France." and insert -- v3.1.0, 3GPP, France, --, therefor.

In Column 5, Lines 64-65, delete "$r_{ac}(0)r^1_{ac}(k)=r_{ac}w_{lag}(k)$" and insert -- $r_{ac}(0)$ and $r^1_{ac}(k)=r_{ac}(k)w_{lag}(k)$ --, therefor.

In Column 5, Line 65, delete "k=1, κ 10" and insert -- k = 1, ..., 10 --, therefor.

In Column 6, Line 31, delete "even" and insert -- given --, therefor.

In Column 6, Line 33, delete "guantization" and insert -- quantization --, therefor.

In Column 6, Line 40, delete "v3.1.0." and insert -- v3.1.0, --, therefor.

In Column 6, Line 43, delete "speciral" and insert -- spectral --, therefor.

In Column 6, Line 43, delete "guantization" and insert -- quantization --, therefor.

UNITED STATES PATENT AND TRADEMARK OFFICE

CERTIFICATE OF CORRECTION

PATENT NO. : 7,209,879 B2
APPLICATION NO. : 10/105884
DATED : April 24, 2007
INVENTOR(S) : Eriksson et al.

It is certified that error appears in the above-identified patent and that said Letters Patent is hereby corrected as shown below:

In Column 6, line 67, delete " $e^{\pm j o_i)}$ " and insert -- $e^{\pm j n_i)}$ --, therefor.

In Column 7, Line 12, delete "$<\omega_{10}\ \pi$" and insert -- $<\omega_{10} <\pi$ --, therefor.

In Column 7, Line 18, delete "$a_{m-i}$-$f_l(i)$" and insert -- $a_{m-i}$-$f_1(i)$ --, therefor.

In Column 7, Line 24, after "0 and" insert -- $\pi$ --.

In Column 7, Line 56, delete "guantization" and insert -- quantization --, therefor.

In Column 8, Lines 5-6, delete "guantization" and insert -- quantization --, therefor.

In Column 8, Line 12, delete "$r^{(2)}(n)=z^{(2)}(n)-p(n)$" and insert -- $r^{(2)}(n)=z^{(2)}(n)-p(n)$ --, therefor.

In Column 8, Line 49, delete "$d_i=f_{i+1}-f_{i-1}$" and insert -- $d_i=f_{i+1}-f_{i-1}$ --, therefor.

In Column 8, Line 51, delete "quantification" and insert -- quantization --, therefor.

In Column 8, Line 57, delete "v3.1.0." and insert -- v3.1.0, --, therefor.

In Column 8, Line 65, delete "$\hat{g}'_c$" and insert -- $g'_c$ --, therefor.

In Column 8, Line 66, delete " $g'_c=10^{0.05(\tilde{E}(n)+\overline{E}-E_l)}$ " and insert -- $g'_c=10^{0.05(\tilde{E}(n)+\overline{E}-E_l)}$ --, therefor.

In Column 10, Line 14, in Claim 3, after "replacing the" delete "fixed".

In Column 10, Line 41, in Claim 9, after "modifying the" delete "fixed".

UNITED STATES PATENT AND TRADEMARK OFFICE

CERTIFICATE OF CORRECTION

PATENT NO. : 7,209,879 B2
APPLICATION NO. : 10/105884
DATED : April 24, 2007
INVENTOR(S) : Eriksson et al.

It is certified that error appears in the above-identified patent and that said Letters Patent is hereby corrected as shown below:

In Column 12, Line 10, in Claim 18, delete “is” and insert -- of --, therefor.

Signed and Sealed this

Twenty-seventh Day of May, 2008

JON W. DUDAS
*Director of the United States Patent and Trademark Office*